United States Patent [19]

Lohnherr

[11] Patent Number: 4,693,811

[45] Date of Patent: Sep. 15, 1987

[54] SIFTER

[75] Inventor: Ludger Lohnherr, Oelde-Sünninghausen, Fed. Rep. of Germany

[73] Assignee: Krupp Polysius Ag, Beckum, Fed. Rep. of Germany

[21] Appl. No.: 909,869

[22] Filed: Sep. 22, 1986

[30] Foreign Application Priority Data

Nov. 7, 1985 [DE] Fed. Rep. of Germany ..... 3539512

[51] Int. Cl.[4] ..... B07B 11/06

[52] U.S. Cl. ..... 209/139.2; 209/148; 209/154; 222/410

[58] Field of Search ..... 209/134, 139.2, 146, 209/148, 150, 138, 154, 145; 222/410; 239/687

[56] References Cited

U.S. PATENT DOCUMENTS

| | | | |
|---|---|---|---|
| 942,251 | 12/1909 | Ernst | 209/148 |
| 2,729,330 | 1/1956 | Newirth | 209/150 |
| 3,017,854 | 1/1962 | O'Brien | 222/410 |
| 3,520,407 | 7/1970 | Rumpf et al. | 209/139.2 |
| 4,296,864 | 10/1981 | Misaka | 209/148 |
| 4,599,163 | 7/1986 | Manola | 209/148 |

FOREIGN PATENT DOCUMENTS

| | | | |
|---|---|---|---|
| 2129121 | 10/1972 | Fed. Rep. of Germany | 209/139.2 |
| 33158 | 10/1970 | Japan | 209/139.2 |
| 780908 | 11/1980 | U.S.S.R. | 209/148 |

*Primary Examiner*—Robert B. Reeves
*Assistant Examiner*—Donald T. Hajec
*Attorney, Agent, or Firm*—Learman & McCulloch

[57] ABSTRACT

The invention relates to a sifter having a dispersing plate which has material passage openings therein. The dispersing plate carries guide elements and distributor elements adjacent such openings which are inclined with respect to the radius of the plate. Such a dispersing plate makes it possible to feed the material to be sifted into the sifting chamber very evenly.

13 Claims, 5 Drawing Figures

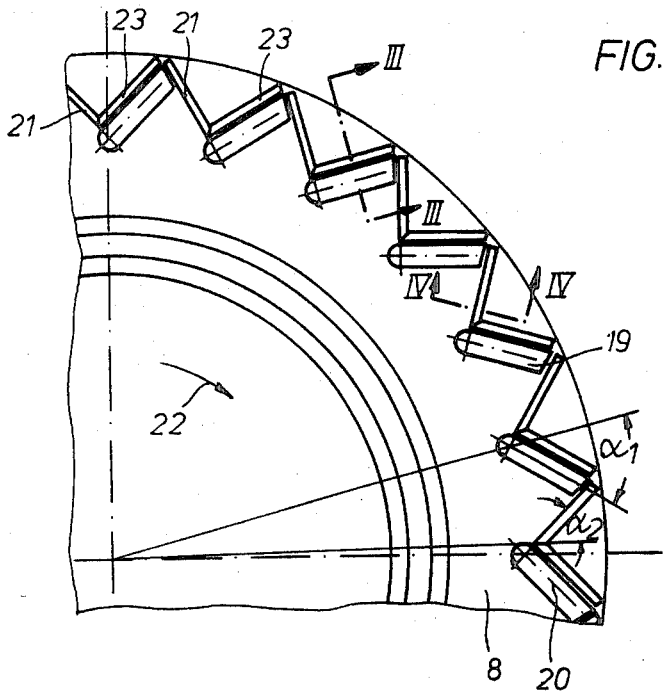
FIG. 2
FIG. 3
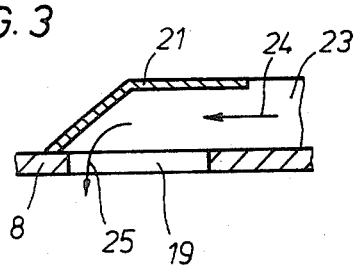
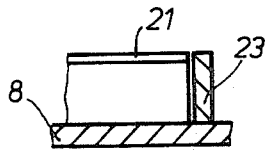
FIG. 4
FIG. 5
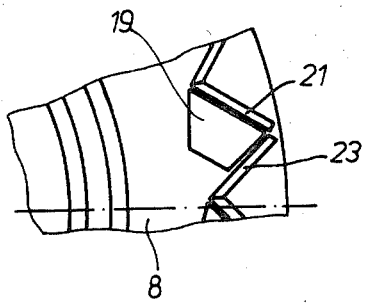

SIFTER

The invention relates to a sifter for separating relatively fine and relatively coarse materials.

BACKGROUND OF THE INVENTION

A sifter of the general type to which the invention relates is known for example from European Patent Specification No. A - 23 320. In that publication the rotor is provided on its upper end face with an annular dispersing plate which encloses a central opening that serves for extraction of the air stream charged with fine material. The material to be sifted is delivered to this dispersing plate by a plurality of material pipes which are arranged on the upper face of the sifter housing around the central pipe which serves for removal of the sifting air. From the edge of the dispersing plate the material is spun radially outwards and deflected downwards by a stationary annular deflecting member in such a way that it falls into the space between the stationary distributor and the rotor.

A significant disadvantage of this known sifter lies in the poor distribution of the material by the dispersing plate. If the material to be sifted is not fed into the sifting chamber completely evenly over the whole periphery then this restricts the precision of separation of the sifter.

The object of the invention, therefore, is to provide a sifter of the general class referred to and which is improved in such manner that, with a simple construction, an absolutely even distribution of the material to be sifted over the whole periphery of the sifting chamber is achieved.

SUMMARY OF THE INVENTION

Tests of a sifter constructed in accordance with the invention have shown, very surprisingly, that by using the construction of the dispersing plate according to the disclosure herein the material to be sifted is fed completely evenly into the sifting chamber. The material flowing outwards on the dispersing plate is delivered to the openings by the distributor elements without any restriction and deflected via the guide elements in such manner that it is deflected downwards through the openings and into the sifting chamber-without any disruptive agglomerations of material. The arrangement of the distributor elements and the guide elements according to the invention ensures that the material located on the dispersing plate cannot bank up under the effect of centrifugal force and remain lying there, which would lead to imbalances in the operation of the dispersing plate and irregularities in the material discharge.

THE DRAWINGS

Apparatus constructed in accordance with the invention is disclosed in the following description and in the accompanying drawings, wherein:

FIG. 2 is a plan view of one quadrant of the dispersing plate;

FIGS. 3 and 4 are sections through a guide element and a distributor element along the lines III—III and IV—IV respectively in FIG. 2; and FIG. 5 is a partial representation of a dispersing plate with a different construction of the openings.

DETAILED DESCRIPTION

Figure 1:
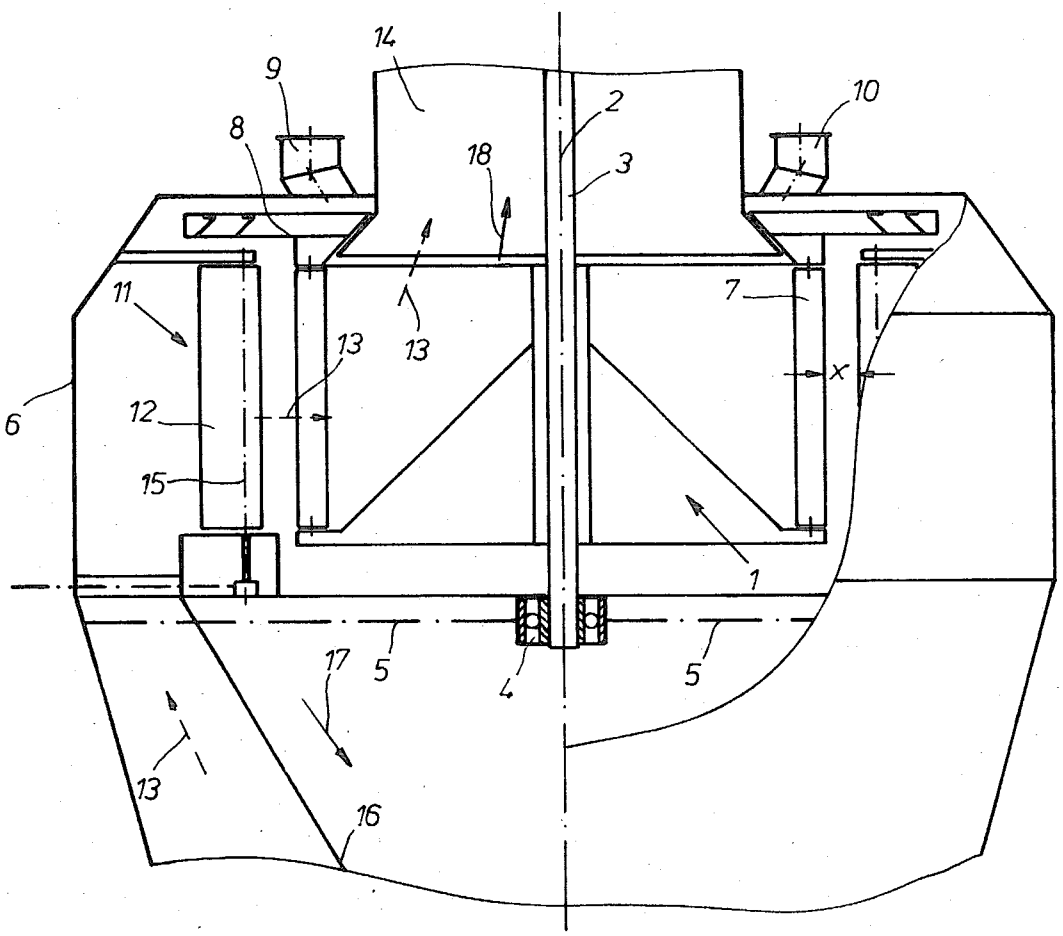
FIG. 1 is a vertical section through the parts of a sifter which are essential for the invention.

The sifter illustrated in FIG. 1 contains a rotor 1 with a vertical axis 2 which is driven via a shaft 3 by a motor which is not illustrated in the drawing. The shaft 3 is mounted at its lower end in a bearing 4 which is retained in the sifter housing 6 by radial struts 5.

The rotor 1 has blades 7 arranged spaced from one another on its periphery, and these blades are preferably adjustable about a vertical axis in known manner.

An annular dispersing plate 8, the construction of which is explained in detail with the aid of FIG. 2, is provided on the upper face of the rotor 1 and rotates with the rotor.

Two material inlet pipes 9, 10 are arranged diametrally and serve for delivery of the material to be sifted onto the dispersing plate 8.

The rotor 1 is encircled by a stationary distributor 11 which contains guide vanes 12 adjustable about vertical axes 15 and serves for delivery of a stream of sifting air (arrows 13) which flows out of the lower part of the sifter housing 6, through the distributor and the rotor 1, and passes outwards through a channel 14 which is arranged centrally above the rotor 1. The rotor 1 is radially spaced from the stationary distributor 11 by a distance X.

The vertical axes of the guide vanes 12 of the distributor 11 are eccentric, so that, in the event of an alteration in the position of the guide vanes, the distance X between the guide vanes 12 and the periphery of the rotor 1 remains constant.

A hopper 16 for collection and discharge of the coarse material (arrow 17) is provided below the rotor 1 and the distributor 11. The fine material (arrow 18) leaves the sifter together with the sifting air through the channel 14 and is separated off for example in a cyclone arranged outside the sifter.

The construction of the dispersing plate 8 is best shown in FIG. 2 and is provided in its peripheral zone with a plurality of openings 19 which are distributed evenly over the periphery and in the embodiment according to FIG. 2 are in the form of slots, the axis 20 of each of which lies at an angle $\alpha 1$, to the radius of the plate 8.

On the outside the openings 19 are defined by guide elements 21 which are inclined by the aforementioned angle $\alpha 1$ with respect to the radial direction and in the direction of rotation of the dispersing plate (arrow 22).

A distributor element 23 which is inclined at an angle $\alpha 2$ with respect to the radial direction and against the direction of rotation of the dispersing plate 8 is mounted between the radially inner end of each of the individual guide elements 21 and the radially outer end of the next leading guide element in the direction of rotation. The guide elements 21 and the distributor elements 23 are thus arranged in zigzag formation, so that the openings 19 extend into the wedge-shaped zones between the adjoining guide elements 21 and the distributor elements 23.

As can be seen from FIG. 3, the guide elements 21 are inclined with respect to the vertical and cover the openings with a clearance. The material (arrow 24) which is delivered to the openings 19 along the distributor elements 23 is deflected downwards (arrow 25) by the guide elements 21 and falls through the openings 19 into the sifting chamber.

The angle $\alpha 1$ which the guide elements 21 form with the radius of the dispersing plate is advantageously between 34° and 54°, and preferably approximately 45°.

The angle $\alpha 2$ which the distributor elements 23 form with the radius of the dispersing plate is advantageously between 25° and 45° and preferably approximately 36°.

The openings 19 are located on a diameter which corresponds approximately to the central or average diameter of the stationary distributor 11. In this way, in contrast to the previously known constructions, the material is fed not into the space X between the distributor 11 and the rotor 1 but into the distributor itself. In this way relatively coarse particles of material are separated off on the walls of the guide vanes 12 and fall directly downwards into the hopper 16 without encumbering that part of the sifting chamber located between the distributor 11 and the rotor 1.

In the further embodiment of the invention illustrated in FIG. 5 the openings 19 have four corners and are trapeziform in shape, with the base of the trapezium defined by the guide elements 21.

In the construction according to the invention the choice of a sufficiently small angle $\alpha 2$ (i.e., less than 45°) taking account of the coriolis force results in the distributor element 23 moving away to some extent from the material stream during the rotary movement of the dispersing plate 8 so that caking of the material on the distributor element and severe wear are avoided.

What is claimed is:

1. In a sifter comprising:

(a) a rotor rotatable about a vertical axis and having blades circumferentially spaced about its periphery for guiding a stream of sifting air;

(b) an annular dispersing plate rotatable with the rotor and positioned on its upper face;

(c) means for delivering material to be sifted to the dispersing plate;

(d) a distributor encircling the rotor and having guide vanes for delivering a stream of sifting air through the distributor and the rotor inwardly thereof;

(e) means above the rotor for discharging the stream of sifting air and relatively fine material entrained therein; and (f) means below the rotor and the distributor for removal of relatively coarse material, the improvement wherein:

(g) the dispersing plate has in its peripheral zone a plurality of openings distributed substantially evenly over the periphery, the openings are arranged so as to have radially outer and inner ends;

(h) guide elements are positioned adjacent the radially outer ends of said openings, said guide elements being positioned so as to form an angle with respect to the radius of said plate and in the direction of rotation of said plate; and (i) distributor elements are positioned between the radially outer ends of the individual guide elements and the radially inner ends of the leading guide elements in the direction of rotation, said distributor elements being positioned so as to form an angle with respect to the radius of said plate and against the direction of rotation of said plate.

2. A sifter according to claim 1, wherein the angle which the guide elements form with the radius of said plate is between 34° and 54°.

3. A sifter according to claim 2 wherein said angle is about 45°.

4. A sifter according to claim 1 wherein the angle which the distributor elements form with the radius of said plate is between 25° and 45°.

5. A sifter according to claim 4 wherein said angle is about 36°.

6. A sifter according to claim 1 wherein said openings are arranged on a diameter which corresponds substantially to the average diameter of said distributor.

7. A sifter according to claim 1 wherein the guide elements are inclined with respect to the vertical and at least partially cover the openings with a clearance.

8. A sifter according to claim 1 wherein the openings extend into wedge-shaped zones between adjoining guide elements and distributor elements which are arranged in zigzag formation.

9. A sifter according to claim 1 wherein the openings are constructed as slots the axes of which are substantially parallel to the axes of the guide elements.

10. A sifter according to claim 1 wherein the openings have four corners.

11. A sifter according to claim 10 wherein the openings are trapeziform in shape, with the base of the trapezium defined by the guide elements.

12. A sifter according to claim 1 wherein the means for delivering material to be sifted contains a plurality of diametrally arranged material delivery tubes.

13. A sifter according to claim 1 including a radial space between the rotor and the distribution and wherein said guide vanes are adjustable about a vertical axis that is eccentric whereby the radial space between the guide vanes and the rotor remains constant regardless of the position of the guide vanes.

* * * * *